US007398884B2

(12) United States Patent
Stegner et al.

(10) Patent No.: US 7,398,884 B2
(45) Date of Patent: Jul. 15, 2008

(54) PACKAGING CUSHIONING MATERIAL, PACKAGING AND METHOD FOR PROTECTING PRODUCTS AGAINST DAMAGE

(75) Inventors: Eric Allen Stegner, Durham, NC (US); Robert William Stegner, Raleigh, NC (US); Christopher John Sattora, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 414 days.

(21) Appl. No.: 11/319,847

(22) Filed: Dec. 28, 2005

(65) Prior Publication Data

US 2007/0144936 A1 Jun. 28, 2007

(51) Int. Cl.
*B65D 81/02* (2006.01)
*B65D 85/30* (2006.01)
*B65B 23/00* (2006.01)

(52) U.S. Cl. ..... 206/592; 53/472; 206/521; 206/523; 206/586

(58) Field of Classification Search ..... 206/521, 206/523, 586, 590–594; 53/472–474
See application file for complete search history.

(56) References Cited

U.S. PATENT DOCUMENTS

| | | | | | |
|---|---|---|---|---|---|
| 3,854,650 | A * | 12/1974 | Hanaue | 206/521 |
| 4,017,016 | A | 4/1977 | Ivy | 229/103.11 |
| 4,522,303 | A | 6/1985 | Starr | 206/588 |
| 4,840,277 | A * | 6/1989 | Waldner | 206/523 |
| 4,851,286 | A | 7/1989 | Maurice | 428/316.6 |
| 4,972,954 | A * | 11/1990 | Dickie | 206/523 |
| 5,207,327 | A | 5/1993 | Brondos | 206/523 |
| 6,158,652 | A | 12/2000 | Ruiz et al. | 229/178 |
| 6,726,017 | B2 | 4/2004 | Maresh et al. | 206/723 |
| 6,997,323 | B2 * | 2/2006 | Maresh et al. | 206/592 |
| 7,114,618 | B2 * | 10/2006 | Arnold | 206/523 |
| 2003/0024971 | A1 | 2/2003 | Jones et al. | 229/109 |

FOREIGN PATENT DOCUMENTS

| | | | |
|---|---|---|---|
| EP | 0216975 | A1 | 4/1987 |
| GB | 2042459 | A * | 9/1980 |
| JP | 53046875 | A | 4/1978 |
| JP | 2002145247 | A | 5/2002 |
| WO | WO8810214 | A1 | 12/1988 |

* cited by examiner

*Primary Examiner*—Bryon P Gehman
(74) *Attorney, Agent, or Firm*—Daniel E. McConnell; Gregory M. Doudnikoff

(57) ABSTRACT

A packaging material which impart fragility capability and is easily manufactured and handled in preparing a product for shipment. The material is fabricated as a planar body having fold lines on which the body may be folded to encircle a product being packaged. The planar body is formed with locking features which enable a handler to easily secure the material about the packaged product and with defined openings facilitating handling.

6 Claims, 4 Drawing Sheets

PACKAGING CUSHIONING MATERIAL, PACKAGING AND METHOD FOR PROTECTING PRODUCTS AGAINST DAMAGE

FIELD AND BACKGROUND OF INVENTION

This invention relates to packaging materials, and more particularly to a material, packaging in which the material is used, and methods by which products are protected against damage otherwise possibly occurring due to shock loads.

In developing a package for product protection, some fundamental information about the product is needed. To protect the product for shock, a fragility level must be determined. Fragility is the maximum acceleration and velocity change the product can withstand before damage occurs. This information is charted to form a damage boundary curve. Ideally the fragility level is determined experimentally through a test procedure such as American Society for Testing Materials (ASTM) D 3332 "Test Method for Mechanical-Shock Fragility of Products, Using Shock Machines." Fragility is usually expressed in units of "g's" (gravitational acceleration) and indicates the maximum acceleration the product can withstand without being damaged. Therefore, the more fragile a product is the lower its fragility level or g-factor. Ranges of a typical cushioning system include very delicate (25-40 g's), delicate (40-60 g's), and moderately delicate (60-85 g's)

Once the shock fragility is known for the product, a cushioning material and package configuration that will provide the necessary protection can be selected. Historically, the use of cushion curves helps a designer identify a material, thickness and loading range based on a pre-determined drop height and required acceleration level.

Packaging material and packages capable of handling determined loads are here referred to as having fragility capability. As will be understood, one of the tasks facing a packaging designer is to provide fragility capability suitable for the product to be packaged and the loads which may be imposed during handling. Another of the tasks facing the designer is that of providing material which can be easily fabricated and easily handled by persons preparing products for shipment.

SUMMARY OF THE INVENTION

With the foregoing in mind, it is one purpose of this invention to provide a packaging material imparting fragility capability and which is easily manufactured and handled in preparing a product for shipment. In particular, the present invention contemplates that a material be fabricated as a planar body of a bi-material having fold lines on which the body may be folded to encircle a product being packaged. The planar body is formed with locking features which enable a handler to easily secure the material about the packaged product and with defined openings facilitating handling.

BRIEF DESCRIPTION OF DRAWINGS

Some of the purposes of the invention having been stated, others will appear as the description proceeds, when taken in connection with the accompanying drawings, in which.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of the invention. Accordingly, the description which follows is to be understood as being a broad, teaching disclosure directed to persons of skill in the appropriate arts, and not as limiting upon the present invention.

Figure 1:
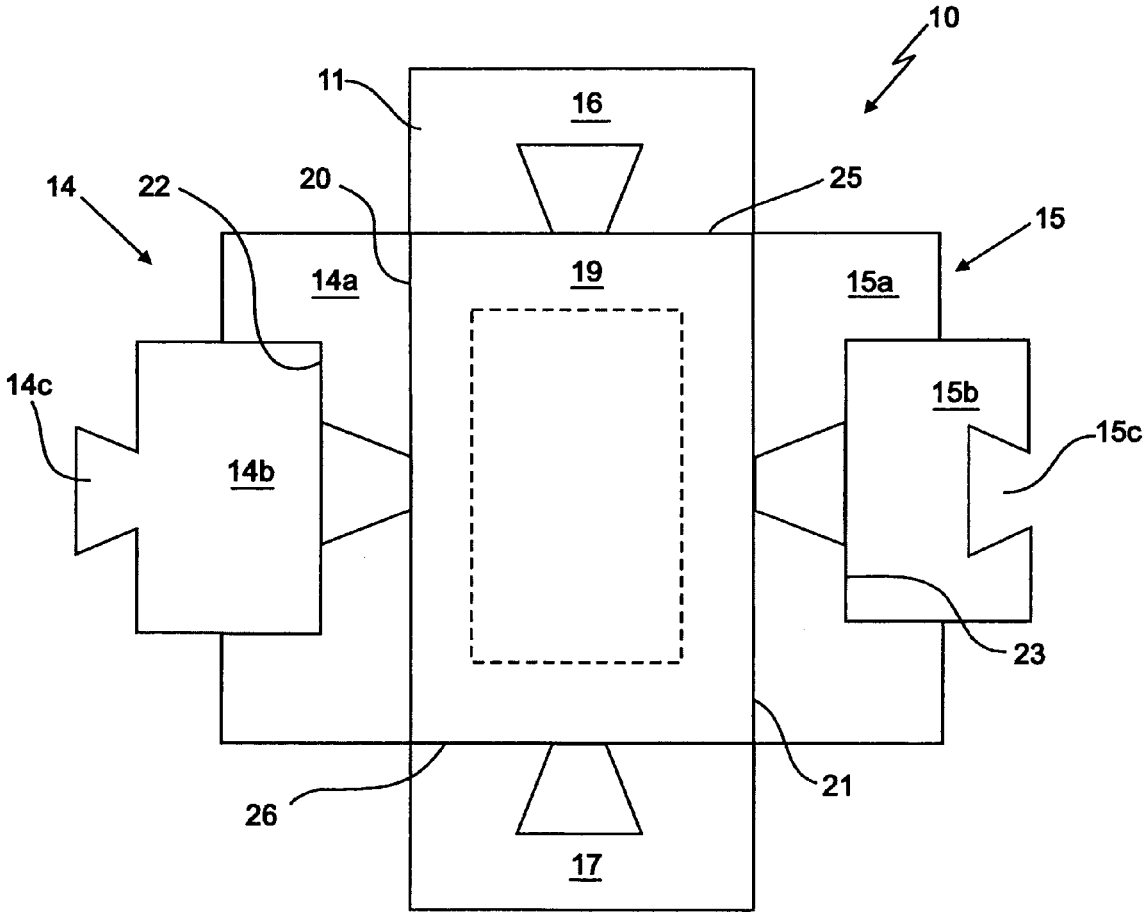
FIG. 1 is a top view of a planar body formed in accordance with this invention.

Referring now to FIG. 1, a planar body 10 is there shown which embodies the present invention. The body 10 is of a deformable material and can be produced by die cutting or other manufacturing process, preferably from a sheet of a bi-material which has a stiffening layer 11 and a cushioning layer 12, visible in FIG. 2. The stiffening layer 11 may, for example, be high density foam, kraft board, a plastic sheet or some similar material. The cushioning layer 12 may, for example, be a low density foam material of choice depending upon the fragility capability desired. The foam may have a density and crush characteristics which impart to an assembled package the protection required for the product being handled, and may be a reticulated or closed cell foam made from any suitable plastic or the like. The body need not be of a bi-material, as a foam material of graduated density may function similarly and persons of skill in the applicable arts will be able to identify other alternatives.

The body 10, as shown, has an irregular outline configuration, shown as a cruciform shape. That is, the body has a general configuration which has pairs of oppositely extending areas which appear somewhat as the arms of a cross. The body is divided by a number of fold lines, which may be defined by score lines or the like formed in the material at the time it is fabricated to shape. The fold lines define seven areas within the irregular configuration.

First and second areas 14, 15 of the planar body 10 are defined on opposite sides of the outline configuration by fold lines 20, 21. Each of these areas 14, 15 is divided by a defined one of the fold lines 22, 23 into a proximal portion 14*a*, 15*a* and a distal portion 14*b*, 15*b*. Each proximal portion 14*a*, 15*a* of each of the first and second areas 14, 15 is closer to the proximal portion of the other of the first and second areas than are the respective distal areas 14*b*, 15*b*. Each distal area portion 14*b*, 15*b* of each of the first and second areas 14, 15 defines a lock portion 14*c*, 15*c* configured to engage the lock portion of the other of the distal area portions. As here shown, the lock portions are formed in the manner of a dovetail, a joint used in woodworking and to form splines in some machined metal components. The characteristic of the dovetail, as here used, is that as the body is folded and the lock portions engaged, the body is held in position encircling a product which has been place on the body as folding begins.

There are third and fourth areas 16, 17 of the planar body 10 on opposite sides of the outline configuration, each extending between the first and second areas 14, 15 and defined by fold lines 25, 26. Together the first and second areas 14, 15 and the third and fourth areas 16, 17 form the arms of the cruciform configuration. A fifth area 19 of the planar body 10 is bounded by the fold lines 20, 21, 25, 26 which bound the first, second, third and fourth areas.

Figure 2:
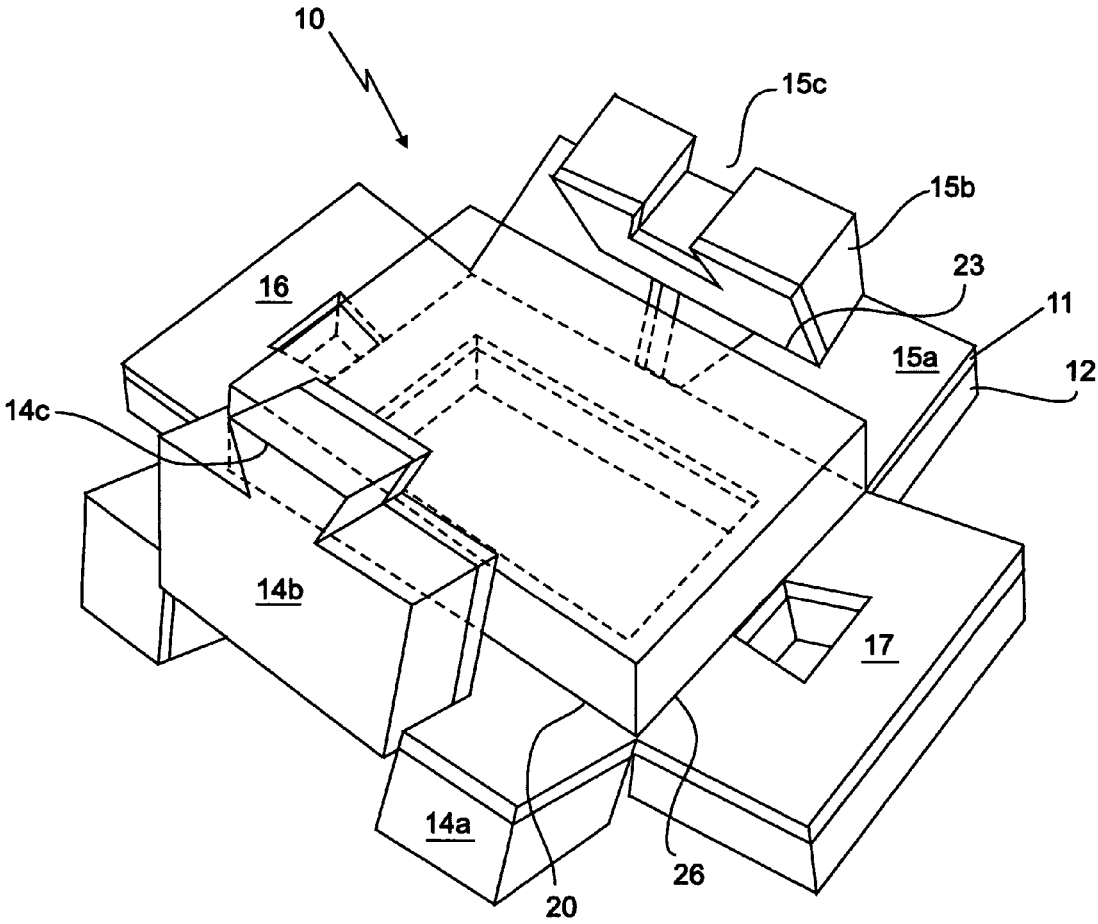
FIG. 2 illustrates the body of FIG. 1 being folded into a configuration for encircling a product being packaged.
Figure 3:
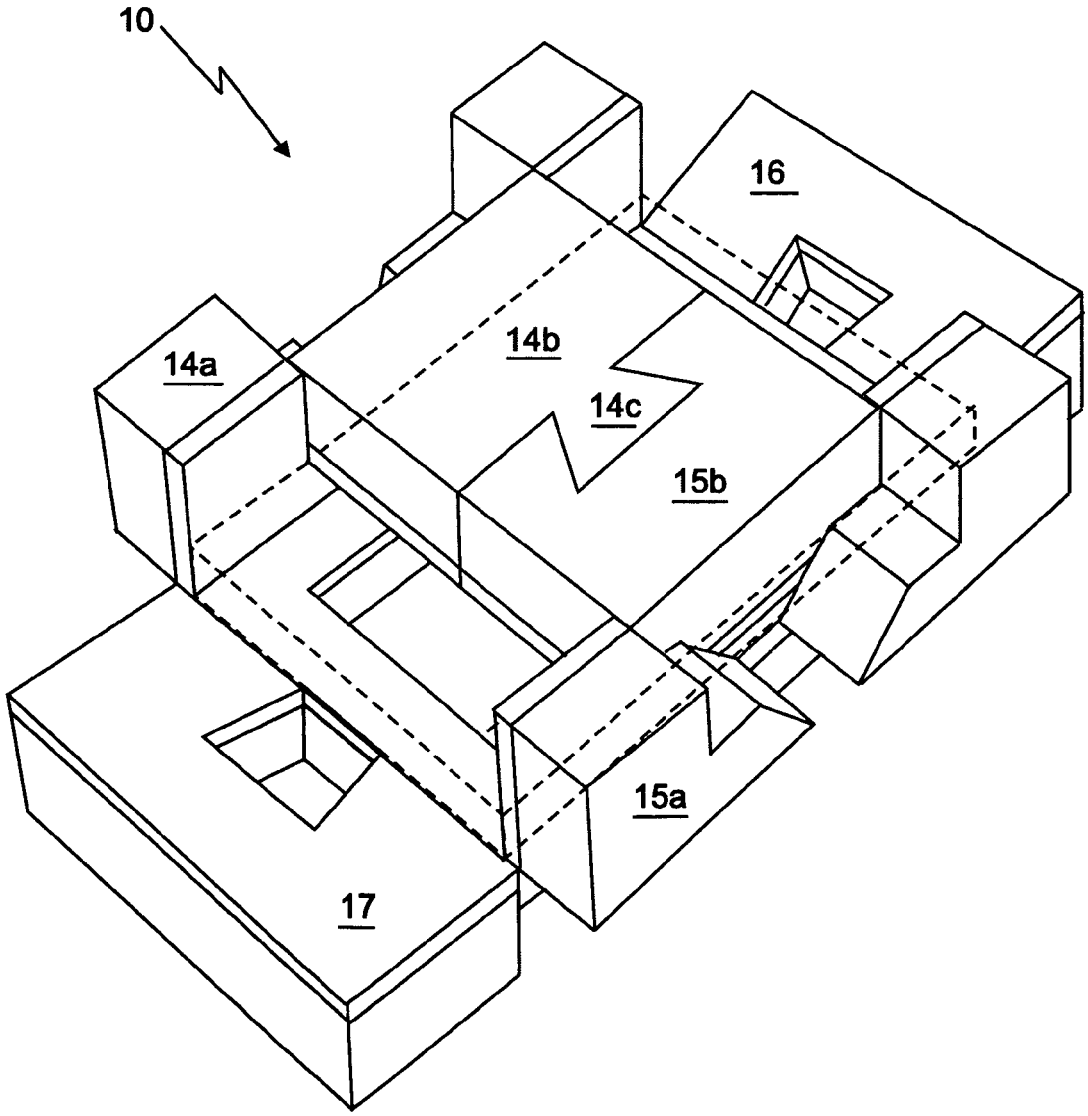
FIG. 3 illustrates the body of FIGS. 1 and 2 as the locking feature is being engaged to secure the body about a product being packaged.

When folded along the fold lines with the lock portions engaged, the planar body forms a body of cushioning material encircling a product positioned on the fifth area. This is shown more particularly in FIGS. 2 through 4. FIG. 2 shows the body 10 in a partial folded position, to make more clear the manner in which the body comes into a three dimensional form as it is folded up along the fold lines. As will be noted, the lock portions 14*c*, 15*c* are drawn into proximity and engaged one with the other as shown in FIG. 3. When locked, a product 30 such as a hard disk drive is encircled by the body of cushioning material and cushioned against forces otherwise impinging on the product during handling and shipping.

Figure 4:
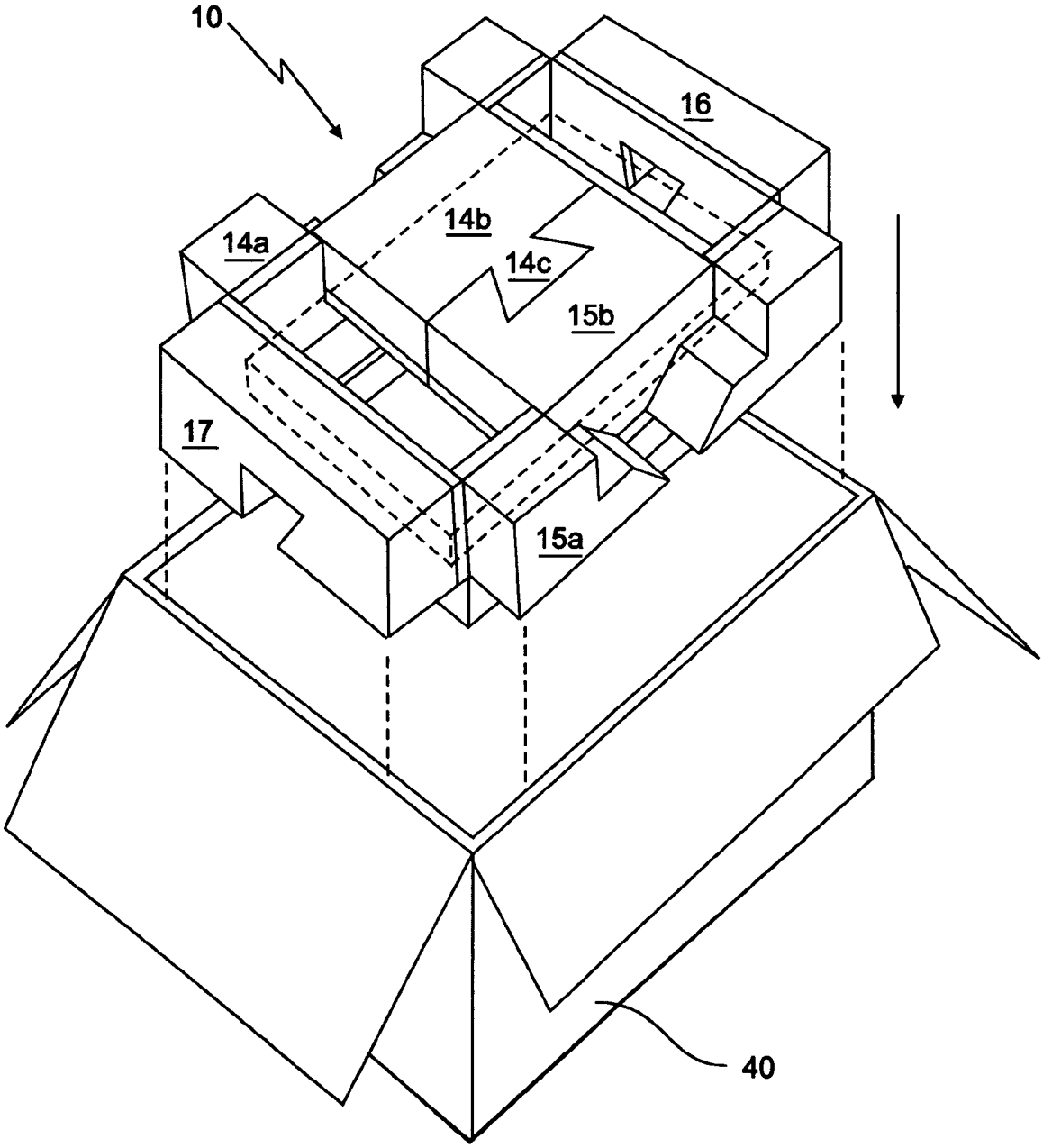
FIG. 4 illustrates the body of FIGS. 1 through 3, encircling a product, being placed within a box.

In order to facilitate handling of the product and the cushioning material and the lessen the weight of the package, open areas are defined in certain of the defined areas of the body. More particularly, the fifth area 19 defines an open area which primarily provides for lessened package weight. Each of the first and second areas 14, 15 defines an open area from which material has been removed, with the open areas extending along the fold lines delineating the proximal and distal portions of the areas. These openings provide for ready engagement with the wrapped product by the hand of a user, facilitating insertion of the wrapped product into an enclosing box or package 40 (FIG. 4).

As will be understood, the present invention contemplates methods of forming packaging materials as here described as well as folding the body into use configuration about a product and inserting the wrapped product into an appropriate box.

In the drawings and specifications there has been set forth a preferred embodiment of the invention and, although specific terms are used, the description thus given uses terminology in a generic and descriptive sense only and not for purposes of limitation.

What is claimed is:

1. Method comprising:

forming a planar body of deformable cushioning material having a predetermined thickness and an irregular outline configuration to have a plurality of fold lines formed in said planar body and defining seven areas within said outline configuration;

a first said area and a second said area of said planar body on opposite sides of said outline configuration each being divided by a defined one of said fold lines into a proximal portion and a distal portion;

each proximal portion of each of said first and second areas being closer to the proximal portion of the other of said first and second areas than are the respective distal areas;

each distal area portion of each of said first and second areas defining a lock portion configured to engage the lock portion of the other of said distal area portions;

a third said area and a fourth said area of said planar body on opposite sides of said outline configuration each extending between said first and second areas;

a fifth said area of said planar body bounded by defined ones of said fold lines which bound said first, second, third and fourth areas; and positioning a product on said fifth area of said planar body.

2. Method according to claim 1 wherein said planar body is cruciform in outline configuration.

3. Method according to claim 1 wherein said fifth area defines an open area from which material has been removed.

4. Method according to claim 1 wherein each of said first and second areas defines an open area from which material has been removed, said open areas extending along the fold lines delineating said proximal and distal portions.

5. Method according to claim 1 wherein said planar body is formed of a bi-material having a cushioning layer and a stiffening layer.

6. Method according to claim 5 wherein said planar body, when folded along said fold lines with said lock portions engaged to form a body of material encircling a product positioned on said fifth area, positions said stiffening layer adjacent the encircled product.

* * * * *